United States Patent [19]

Jürgens et al.

[11] Patent Number: 4,614,232

[45] Date of Patent: Sep. 30, 1986

[54] DEVICE FOR DELIVERING FLOWABLE MATERIAL

[75] Inventors: Rainer Jürgens, Celle-Osterloh; Johann Biehl, Celle, both of Fed. Rep. of Germany

[73] Assignee: Norton Christensen, Inc., Salt Lake City, Utah

[21] Appl. No.: 711,692

[22] Filed: Mar. 14, 1985

[30] Foreign Application Priority Data

Mar. 19, 1984 [DE] Fed. Rep. of Germany ..... 3409970

[51] Int. Cl.[4] ..... E21B 43/00; E21B 43/12

[52] U.S. Cl. ..... 166/105.5; 166/106; 166/369; 418/48; 417/405

[58] Field of Search ..... 166/105.5, 106, 369; 175/107; 418/48; 417/352, 405

[56] References Cited

U.S. PATENT DOCUMENTS

| | | | |
|---|---|---|---|
| 2,483,370 | 9/1949 | Moineau | 418/48 |
| 2,739,650 | 3/1956 | Hill | 166/106 |
| 3,203,350 | 8/1965 | Chang | 418/48 |
| 3,840,080 | 10/1974 | Berryman | 175/107 |
| 3,912,426 | 10/1975 | Tschirky | 175/107 X |
| 4,083,660 | 4/1978 | Newbrough | 166/106 X |
| 4,386,654 | 6/1983 | Becker | 166/105.5 |
| 4,415,316 | 11/1983 | Jürgens | 175/107 X |

*Primary Examiner*—James A. Leppink
*Assistant Examiner*—Matthew Smith
*Attorney, Agent, or Firm*—Walter Fred

[57] ABSTRACT

A device for delivering flowable materials from a production bore (2), consisting of a source of pressurized medium (1), a pressurized medium conduit (3) for conducting the pressurized medium into the bottom area of the bore, the pressurized medium being used to operate drive means (5) coupled to a pump (6) for the flowable material. The drive means (5) and the pump (6) are both rotary displacement devices having a spiral rotor (10, 12) which describes an eccentric rotational path within a spiral stator (11,13). The rotor (10) and the stator (11) of the drive means (5) and the rotor (12) and the stator (13) of the pump (6) have the same eccentricity and are rigidly connected to one another.

9 Claims, 8 Drawing Figures

DEVICE FOR DELIVERING FLOWABLE MATERIAL

BACKGROUND OF THE INVENTION

1. Field of the Invention

This invention relates to devices for delivering flowable material and more particularly concerns devices for delivering flowable material from an underground borehold.

2. Description of Prior Art

U.S. Pat. No. 4,386,654 to Becker describes a downhole pump for delivering flowable material which comprises a helical screw type rotor mounted within a resilient stator. The pump is connected to drive means which also comprises a helical screw type rotor mounted within a resilient stator, the rotor being driven by pressurised oil delivered from the ground surface. The drive means is connected to the pump by drive transmission means including universal joints and a drive shaft.

An object of the present invention is to provide a device for delivering flowable material from an underground borehole which is simpler in construction and relatively easy to manufacture.

Another object of the present invention is to provide a device of the above type which is more reliable and able to withstand better the extreme operating conditions often present in a production borehole.

SUMMARY OF THE INVENTION

According to the present invention there is provided a device for delivering flowable material from an underground borehole comprising:

a source of pressurised medium;

drive means adapted to be driven by said pressurised medium;

conduit means connecting said source of pressurised medium and said drive means;

drive transmission means associated with said drive means;

a pump arranged to be driven by said drive transmission means and said transmission means;

a pump inlet and a pump outlet whereby when the pump is driven it delivers flowable material from the inlet to the outlet;

a delivery conduit communicating with the pump outlet;

the drive and pump both being of a rotary displacement type comprising a spiral rotor and a spiral stator;

the stator being mounted in a housing;

the rotor being mounted for eccentric rotation within the stator;

the drive transmitting means comprising a rigid connection; and the rotor and stator of both the pump and the drive means having the same eccentricity.

The concept of designing the rotors and stators of the drive means and pump to have the same eccentricity enables a rigid drive transmission means to be utilised, thereby avoiding the provision of universal joints. This simpler design with its reduced number of moving parts is more reliable, has a reduced risk of breakdown and provides for longer maintenance free operation.

In a preferred embodiment the working chamber volume of the pump is substantially greater than the working chamber volume of the drive means. This arrangement provides for the delivery of a greater volume of flowable material from the borehole than the volume of pressurised medium which has to be supplied to the drive means.

The use of a smaller volume of pressurised fluid requires a proportionate increase in pressure and for this reason it is preferred to use a multistage drive means to reduce the pressure drop between stages and thus make it relatively easy to seal the working parts of the drive means against leakage.

The relative increase in working chamber volume of the pump can be achieved by providing the rotor and stator with a relatively large spiral pitch, by providing a relatively large cross-sectional area of the working chamber or by a combination of both.

It is advantageous that the number of stages $S_A$ of the drive means, the number of stages $S_p$ of the pump, the working chamber volume $V_p$ of the pump, the working chamber volume $V_A$ of the drive means and the overall efficiency $\eta_{GA}$ and $\eta_{GP}$ of the drive means and the pump meet the formula $$\frac{S_A}{S_p} = \frac{V_p}{V_A} \cdot \frac{1}{\eta_{GA} \cdot \eta_{GP}}.$$

This enables the same load to be achieved on the sealing edges between adjacent working chambers, taking into account the drive and pump losses occurring during operation.

The spiraled rotors of both the drive means and the pump are designed to rotate together in the same direction. However, in some embodiments the drive and pump rotors spiral in the same direction of rotation and consequently the flow of materials through both the drive means and the pump is in the same direction. This tends to balance the axial reaction forces exerted on the rotors of the drive means and the pump. Thus if the reaction forces are of the same magnitude, the resulting forces to be absorbed by the axial bearing is greatly reduced.

One way of achieving this flow path is to provide an intermediate space between the stator casing or rotor casing and a support casing therefor, by which means the existing available space can be used and an increase in the housing diameter can be avoided.

A particularly compact embodiment is achieved by arranging the stators of the pump and the drive means as outer and inner stators and arranging the rotors to be carried by a common body mounted for rotation between the stators.

To achieve the smallest possible flow losses of flowable material to be delivered, the pressurised medium is preferably conducted through a pressurised medium conduit in the form of a standard diameter hollow tube inserted into the bore, so that the annular space, which has a larger cross-section compared with the hollow tube, is available between the hollow tube and the bore lining as a delivery conduit for the flowable material. Furthermore this embodiment has the advantage that chemically aggressive flowable materials are kept away from the bore lining.

In this case, the pressurised medium is fed to the deive means through the annular space between the hollow tube and the bore hole lining and the flowable material is delivered through the hollow tube. The diameter of the tube will be selected as appropriate to the circumstances.

The pressurised medium will usually be a pressurised working oil and the flowable material will be a material such as crude oil to be extracted from below the surface of the ground and delivered to the surface.

BRIEF DESCRIPTION OF THE DRAWING

The invention will now be further described with reference to several embodiments which are shown in the accompanying drawings, wherein.

DESCRIPTION OF THE PREFERRED EMBODIMENT

Figure 1:
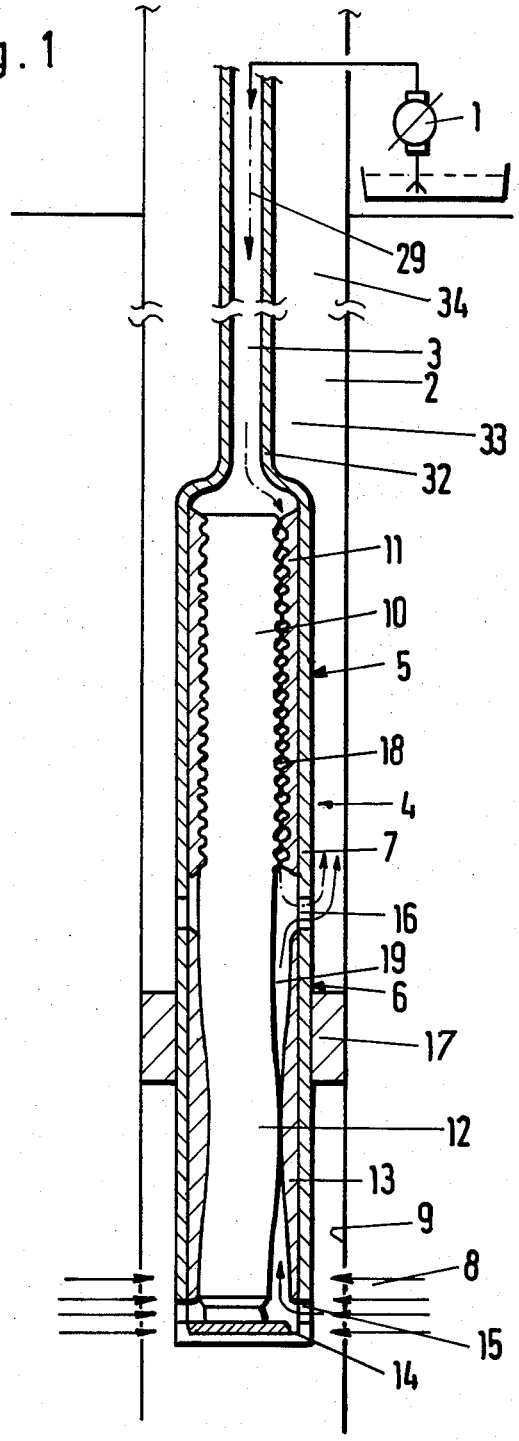
FIG. 1 is a diagrammatic broken longitudinal section through a device according to the invention.

The device shown in FIG. 1 comprises an above-ground source 1 of pressurised medium which supplies a fluid under pressure through a conduit 3. The conduit is in the form of a hollow tube 32 which extends down to an assembly 4 including a housing 7, a drive means 5 and a pump 6 located at the bottom of the bore 2. The bore 2 is provided with a bore hole lining 9.

It will be appreciated that the assembly 4 can also be arranged at a position other than at the bottom of the bore 2 where flowable material 8 penetrates from a deposit into the bore 2 through apertures in the bore hole lining 9.

In detail, the drive means 5 consists of a spiral rotor 10 which is located in a spiral stator 11. A pump 6 is located beneath the drive means 5, the pump, like the drive means, comprising a rotor 12 and a stator 13. The drive means and the pump are enclosed by the housing 7.

The rotor 12 of the pump 6 is rigidly connected to the rotor 10 of the drive means 5 and the lower end face of the rotor 12 is supported against an axial bearing 14. As can be seen from FIG. 1, the rotor 10 and the stator 11 have the same eccentricity as the rotor 12 and the stator 13, so that both rotors 10 and 12 execute the same eccentric movement during operation.

The cross-sectional areas of the working chambers 18 and 19 of the drive means 5 and the pump 6 are the same but the pump rotor 12 and the pump stator 13 have ten times the pitch of the drive rotor 10 and the drive stator 11. Consequently, for every rotor revolution, the pump 6 circulates ten times the volume of the pressurised medium delivered to the drive means 5. As a result during operation, the volume of material discharged at ground level is made up of one part pressurised medium 30 and nine parts of flowable material 8 extracted.

If loss-free conditions are assumed, the drive means 5 would have to be pressurised at ten times the pressure which the pump 6 provides; however, taking into account the overall efficiency of the drive means 5 and the pump 6 and assuming overall efficiency values of 70% each, a value of twenty times that of $\Delta P_p$ is obtained for $\Delta P_A$ according to the following formula:

$$P_A = \frac{V_p \cdot \Delta P_p}{V_A \cdot \eta_{GA} \cdot \eta_{GP}}$$

wherein $V_A$: working chamber volume of the drive means, $V_p$: working chamber volume of the pump, $\Delta P_A$: pressure difference over the drive means, $\Delta P_p$: pressure difference over the pump, $\eta_{GA}$: overall efficiency of the drive means, $\eta_{GP}$: overall efficiency of the pump.

To overcome the pressure drop over the drive means 5 through the sealing edges of its working chambers 18, the drive means 5 have twenty times the number of stages of the pump 6. The pressure component acting on each sealing edge thus corresponds to that of the pump 6, so that both the drive means and the pump operate under the same load.

In the assembly 4 as shown in FIG. 1, the flowable material 8 flows through the openings 15 into the pump 6 and, together with the pressurised medium 29, through openings 16 into the annular space 34, between the bore hole lining 9 and the hollow tube 32. This annular space serves as a delivery conduit 33. A direct path between the openings 15 and 16 is prevented by the packing 17, which is arranged between the housing 7 and the bore hole lining 9.

In this embodiment it will be seen looking from the same end direction that the spirals of the drive rotor 10 and drive stator 11 are opposite to and the reverse of the spirals of the pump rotor 12 and pump stator 13. Hence, upon being simultaneously rotated in the same direction, the axial reaction forces applied to the rotors and axial bearing 14 are therefore cumulative.

Figure 2:
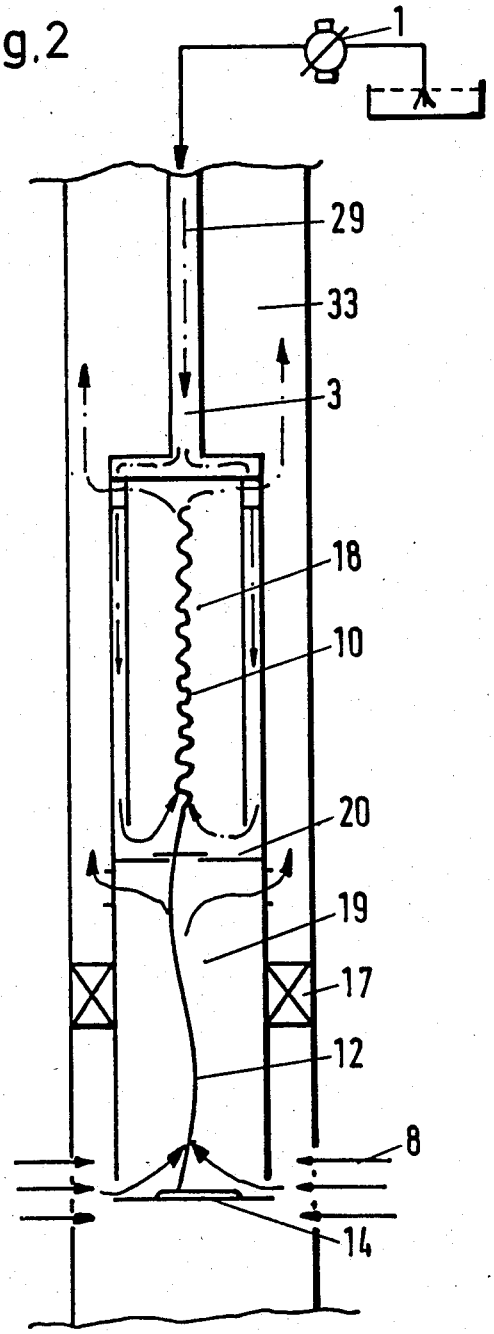
FIGS. 2, 3 and 4 are diagrammatic sections similar to that of FIG. 1 showing alternative embodiments.

On the other hand, the alternative embodiment shown in FIG. 2 comprises a drive 5 and a pump 6 having spirals extending in the same direction of rotation. Whereas the pump 6 is identical to that shown in FIG. 1, pressurised medium 29 is arranged to flow through the drive means 5 in the reverse direction, that is, from the bottom upwards. To achieve this, the pressurised medium conduit 3 is routed past and parallel to the working chamber 18 of the drive means 5 and is directed into it from below.

The use of the same direction of flow in the drive means 5 and the pump 6 lead to opposed axial reaction forces being applied to the rotors 10 and 12. Consequently the axial reaction forces on rotors 10 and 12 compensate one another and considerably reduce the load on the axial bearing 14. This embodiment, however, still requires a seal 20 to separate the working chamber 18 of the drive means 5 from the working chamber 19 of the pump 6.

Figure 3:
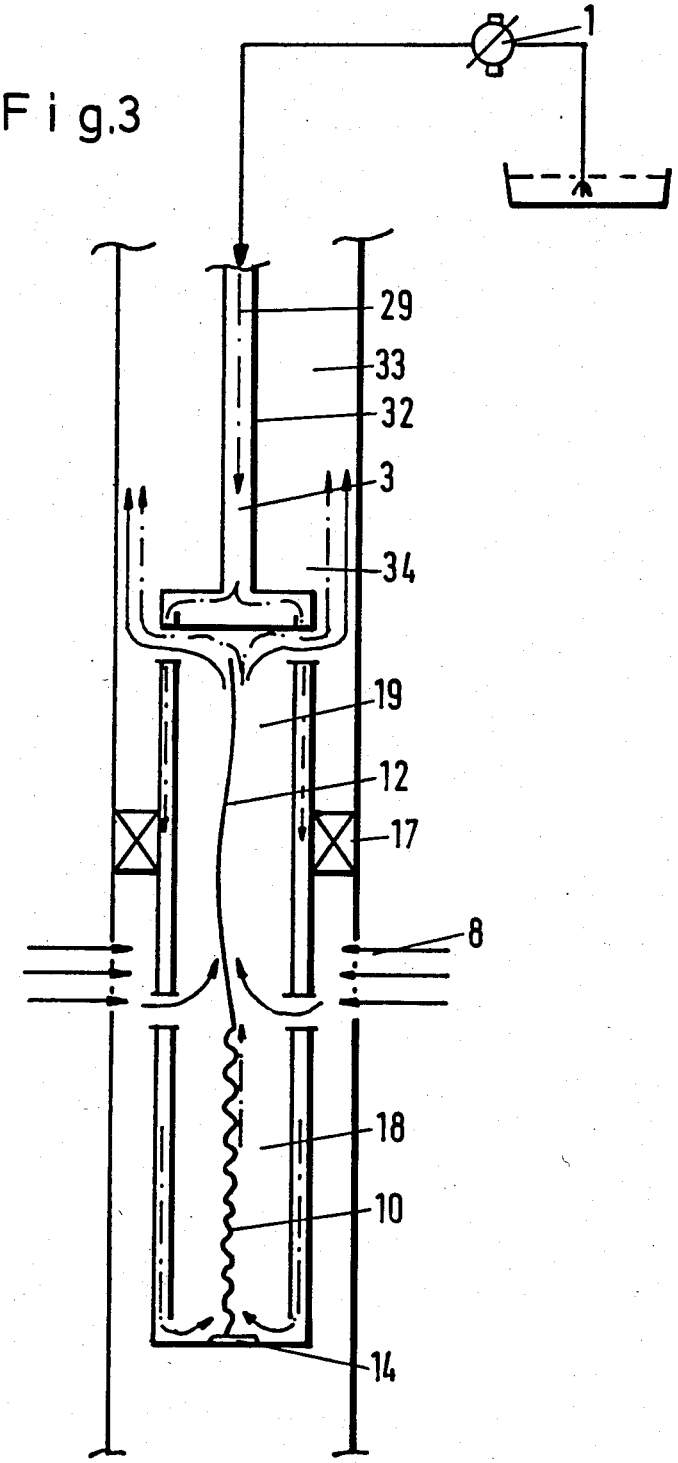

In the embodiment shown in FIG. 3 the pressurised medium 29 is fed to the drive means 5 from below as in the embodiment shown in FIG. 2. In this embodiment however the arrangement of the drive means 5 and pump 6 is reversed in the housing 7, by which means a seal between the working chamber 18 of the drive means 5 and the working chamber 19 of the pump 6 can be dispensed with. In this embodiment the flowable material 8 enters the bore hole lining 9 through apertures at a higher level than in the embodiment of FIG. 2.

Figure 4:
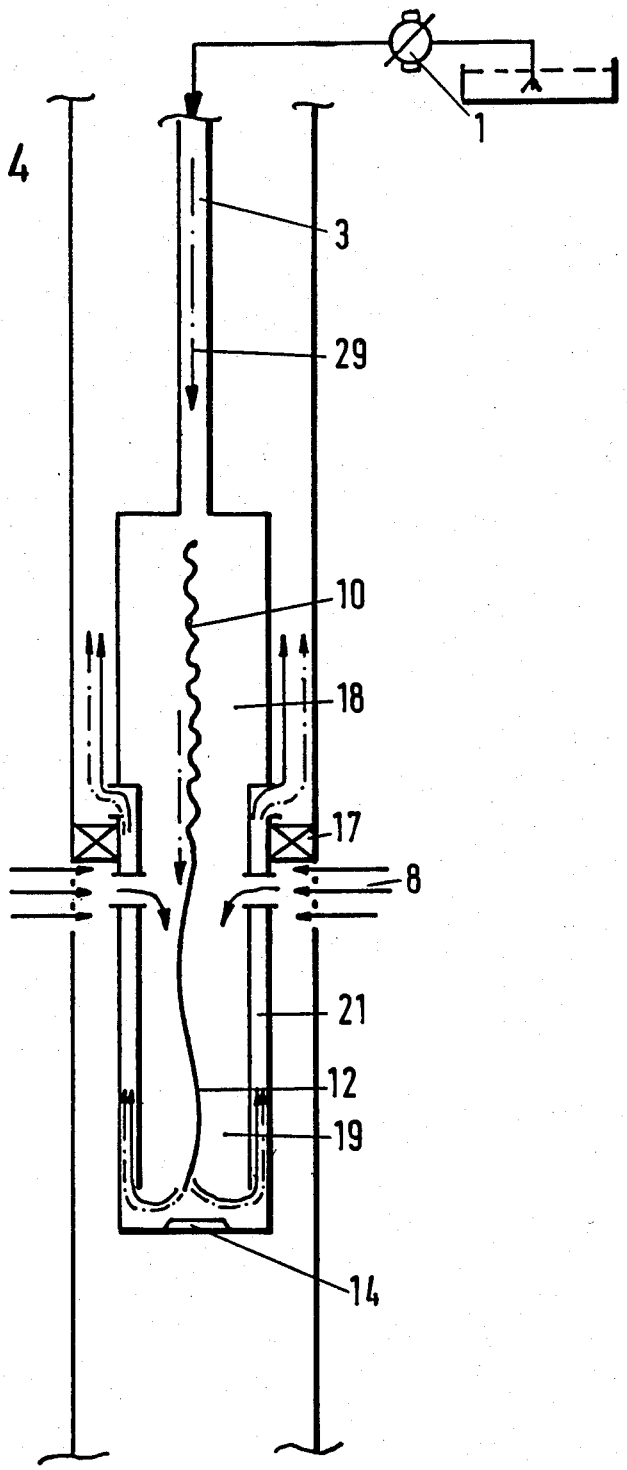

Another embodiment of the invention is shown in FIG. 4. In this embodiment the arrangement of the drive means 5, the pump 6 and the conduit for pressurised medium are the same as the embodiment shown in FIG. 1. However, the spiral rotor and stator of the pump 6 are designed in the same direction of rotation as in the drive means 5, so that flowable material 8 flows through the pump 6 from top to bottom and, after reversal of direction, is delivered upwardly through a conduit 21 which extends parallel to the working chamber 19 of the pump 6 and between the stator thereof and the housing.

Figure 6:
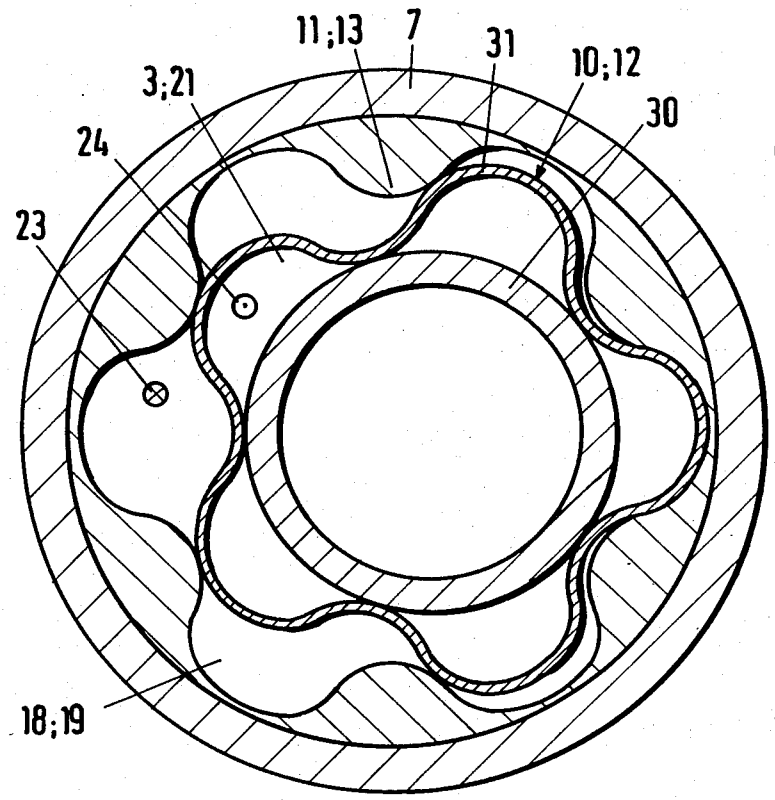
FIGS. 5 and 6 are cross-sections through two alternative embodiments of drive means or pump.
Figure 5:
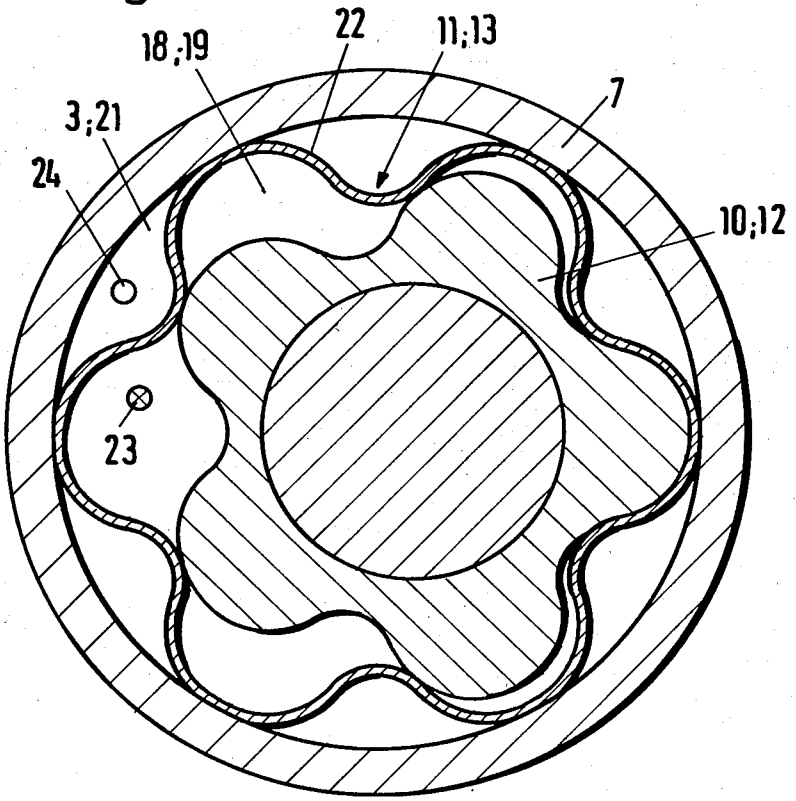

FIGS. 5 and 6 are cross-sections of alternative arrangements of rotor and stator which can be utilised in a pump or drive means. In the description of these FIGS. the reference numerals of similar parts are the same as those used in FIGS. 1 to 4.

In FIG. 5, the stator 11, 13 is in the form of a shaped casing 22 disposed within the housing 7. The intermediate space between the walls of the shaped casing 22 and the housing 7 are used as a conduit such as the conduits 3 and 21 which extend parallel to the working chambers 18 and 19. As indicated by the symbols 23 and 24, pressurised medium 29 or flowable material 8 flows through the working chambers 18 and 19 in a direction into the plane of the drawing, whereas they flow through the conduit 21 and 3 in a direction out of the plane of the drawing.

As shown in FIG. 6, it is also possible, either additionally or alternatively, to design the rotors 10 and 12 as a casing 31 fixed to a support casing 30 and to use the intermediate space between the casing 31 and the support 30 as a conduit 3 or 21, or to design the rotors 10 and 12 with a hollow section and to use the space so defined for this purpose.

Figure 7:
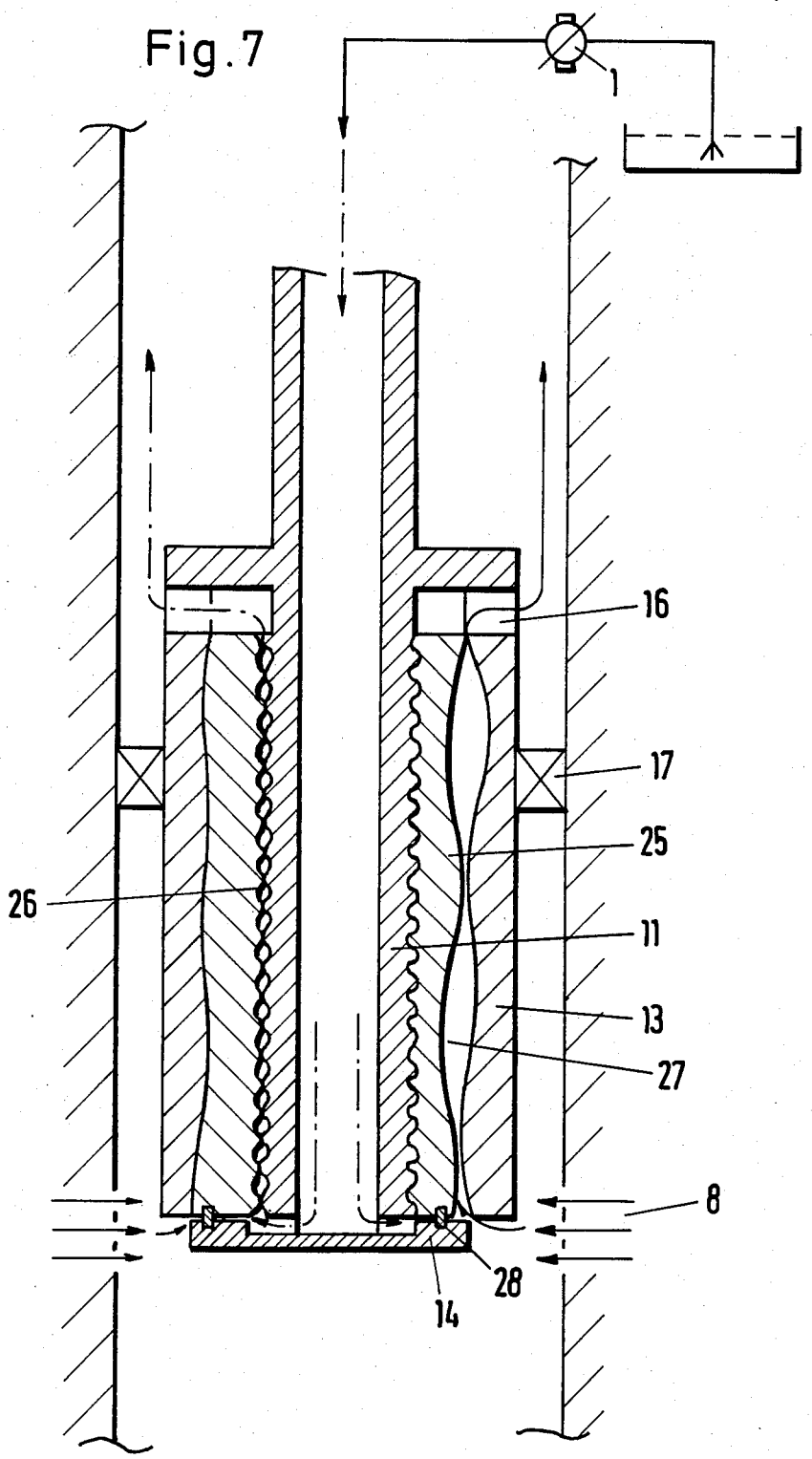
FIG. 7 is a diagrammatic broken longitudinal section of a further embodiment of the device with a common rotor for the drive means and pump.

In the embodiment shown in FIG. 7, a more compact construction is achieved by arranging the drive means 5 and the pump 6 to nest inside one another. In this case, the drive means is formed by the inner stator 11 and the inner area 26 of a common rotor 25. The outer stator 13 and the outer area 27 of the common rotor 25 comprise the pump.

In addition, an axial seal 28 is provided for the axial bearing 14. The pressurised medium 29 is fed to the drive means 5 via the hollow inner stator 11 and flows through the associated working chamber 18. The flowable material 8, which in the lower area enters into the working chamber 19 of the pump 6, also flows upwards through the working chamber 19. The pressurised medium 29 and the flowable material 8 leaves the housing 7 via common outlet openings 16. As can be seen from the drawing, an especially short compact construction can be achieved by this arrangement.

Figure 8:
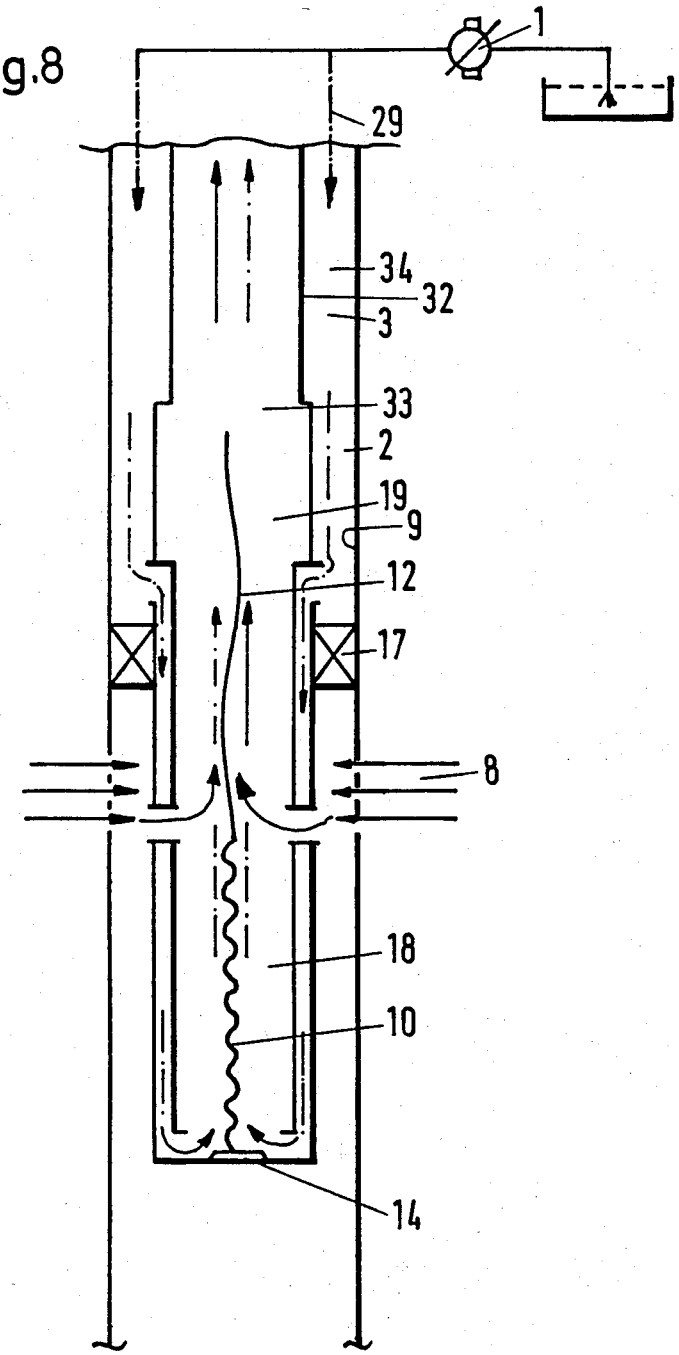
FIG. 8 is a diagrammatic longitudinal section of another embodiment of the invention.

FIG. 8 shows yet a further embodiment of the invention in which the pressurised medium 29, instead of being conducted through the hollow tube 32, is forced through the annular space 34 between the hollow tube 32 and the bore hole lining 9, and the flowable material 8 is delivered through the hollow tube 32. The arrangement of the drive means 5 and the pump 6 as shown are as shown in FIG. 3 but each of the other arrangements shown could also be adapted for use, in this embodiment. This alternative has the advantage that it protects the bore hole lining 9 in the case of chemically aggressive flowable materials. It is easier and cheaper to make the hollow tube 32 from a more corrosion or wear-resistant material and also it is easier to replace the hollow tube 32 in the event of wear, damage or corrosion.

We claim:

1. A device for delivering flowable material from an underground borehole comprising:

a source of pressurized medium;

drive means including a drive working chamber of predetermined working volume, adapted to be rotatably driven by a predetermined working volume of said pressurized medium passed therethrough from an inlet end to an outlet end during each revolution thereof;

pressurized medium conduit means connecting said source of pressurized medium and said drive means;

drive transmission means comprising a rigid connection adjacent to, associated with and connected to said drive means;

a pump arranged to be adjacent to, rigidly connected to and rotatably driven by said drive transmission means and said drive means;

said pump having a pump inlet communicating with the bore hole and flowable material therein;

a pump outlet spaced from the pump inlet and a pump working chamber between said pump inlet and pump outlet of greater working volume than the predetermined working volume of the drive working chamber whereby when the pump is driven it delivers per revolution a greater volume of flowable material from the pump inlet to the pump outlet than the predetermined working volume of pressurized medium passed during each revolution of the drive means;

a delivery conduit communicating with and extending from the pump outlet;

sealing means located between the housing and bore hole wall at a point between the pump inlet and the pump outlet;

the drive means and pump are axially aligned adjacent one another and both being of a rotary displacement type each comprising a spiral rotor mounted for eccentric rotational movement relative to a spiral stator attached to a housing;

the spiral rotor of both the pump and the drive means being rigidly connected and aligned to rotate together in the same direction about one axis and having the same eccentric rotational movement relative to each of the spiral stators and a common axis of the spiral stators; and axial bearing means fixed relative to the housing and adapted to be engaged by an end portion of one of the spiral rotors and take the axial force applied to and by the rotors during the eccentric rotational movement thereof.

2. A device according to claim 1 in which the spiral rotor and the spiral stator of the drive means are arranged to spiral in the same direction as the spiral rotor and spiral stator of the pump; and in which the drive means is a multistage drive means and has a greater number of stages than the pump.

3. A device according to claim 1 in which the multistage drive means has a ratio of the greater number of stages of the drive means to the number of stages of the pump approximately equal to the product of the ratio of the working chamber volume of the pump to that of the drive means and reciprocals of the overall efficiency of the drive means and the pump.

4. A device according to claim 1 in which the pressurized medium which has driven and passed through the drive means and the flowable substance delivered from the pump have an upward flow path which is parallel to the axes of the rotors and stators.

5. A device according to claim 4 in which the flow path is defined by an intermediate space between a spiral stator casing or spiral rotor casing and a support casing associated with the spiral stator casing or spiral rotor casing.

6. A device according to claim 1 in which one of the two spiral stators of the pump and the drive means is arranged as an outer spiral stator and the other as an inner spiral stator, and the associated spiral rotors of the pump and drive means are carried by and connected to the outer and inner sides of a common body mounted for eccentric rotational movement between the inner and outer spiral stators.

7. A device according to claim 6 in which the spiral stators of the pump and the drive means are located within the same axial length of the device.

8. A device according to claim 1 in which the pressurized medium conduit means is formed by a hollow tube within the bore hole, and the delivery conduit is formed by an annular space surrounding the hollow tube.

9. A device according to claim 1 in which the delivery conduit is formed by a hollow tube within the bore hole, and the pressurized medium conduit means is formed by an annular space surrounding the hollow tube.

* * * * *